United States Patent [19]

Manning et al.

[11] Patent Number: 4,571,209

[45] Date of Patent: Feb. 18, 1986

[54] ARTICULATED TOY FIGURE

[76] Inventors: Peter R. Manning, Wathen Cottage, Lower Meend, Briavels, Gloucestershire; A. John Dixon, Hooks Farm, Woods Corner, Dallington, Sussex, both of United Kingdom

[21] Appl. No.: 492,442

[22] Filed: May 6, 1983

[51] Int. Cl.[4] ..... A63H 3/46

[52] U.S. Cl. ..... 446/375; 446/376; 264/138; 264/242

[58] Field of Search ..... 446/375, 376, 373, 390, 446/382, 383, 377, 378, 381; 425/DIG. 57, DIG. 109; 264/274, 259, 279, 138, 232, 242, 222, 157, DIG. 30

[56] References Cited

U.S. PATENT DOCUMENTS

| | | | |
|---|---|---|---|
| 1,595,203 | 8/1926 | Leathers | 446/375 |
| 3,624,691 | 11/1971 | Robson | 446/374 |
| 4,470,784 | 9/1984 | Piotrovsky | 446/376 X |

FOREIGN PATENT DOCUMENTS

| | | | |
|---|---|---|---|
| 1200096 | 12/1959 | France | 264/242 |

*Primary Examiner*—Mickey Yu

*Attorney, Agent, or Firm*—Staas & Halsey

[57] ABSTRACT

An articulated toy figure, which does not require manual assembly of individual elements, is made by injection molding a frame using a first set of mold inserts. The frame includes elements that are joined together by breakable portions and that provide half hinges. The frame is left in the mold while the first set of inserts is replaced by a second set configured to produce completion elements around the frame. These completion elements span the individual elements of the frame and complete the half joints provided thereby. The frame elements, along with the completion elements molded around them, result in an automatically assembled figure produced by two molding operations. If desired, the figure can be painted before it is flexed to break the breakable portions of the frame in order to yield a fully mobile articulated toy figure.

22 Claims, 7 Drawing Figures

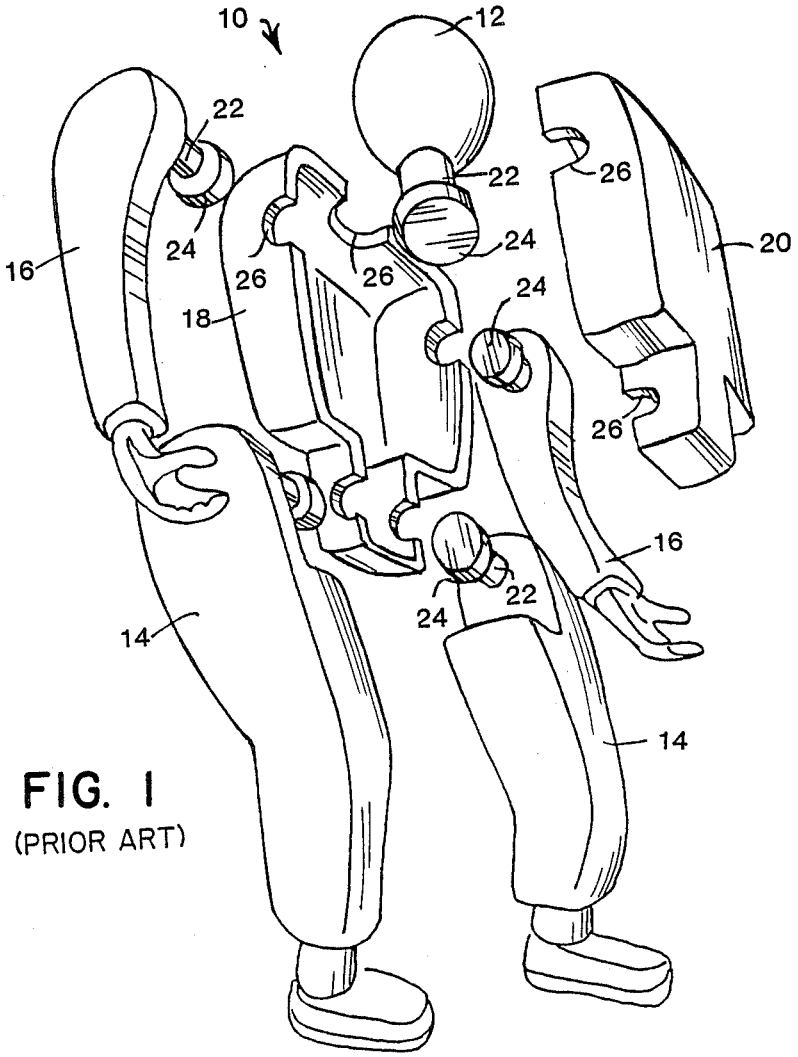
FIG. 1
(PRIOR ART)
FIG. 6
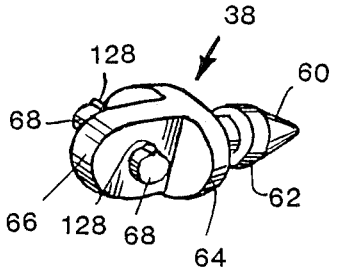

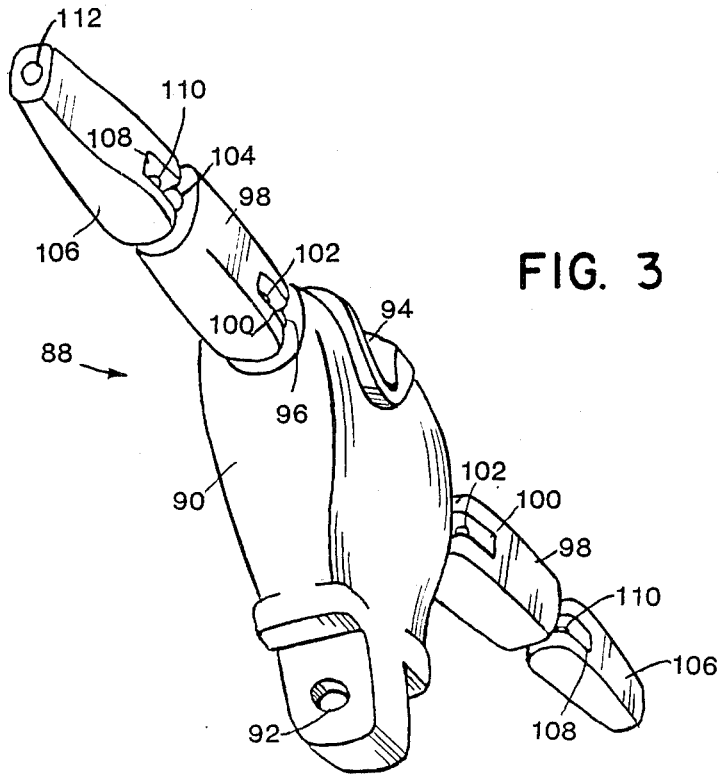
FIG. 3
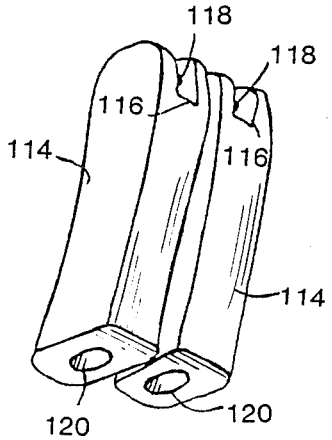

ARTICULATED TOY FIGURE

BACKGROUND OF THE INVENTION

The present application is directed to articulated toy figures having elements that are movable with respect to one another, and more particularly to toy figures which have a high degree of articulation but which nevertheless can be inexpenisvely produced without the traditional assembly operations.

There is a continuing demand for articulated figures in the toy field, and consequently several techniques for achieving articulation have been developed. A typical example is illustrated in FIG. 1, which illustrates a doll 10 having a head element 12, leg elements 14, arm elements 16, and body elements 18 and 20, all of which can be made of plastic. Shafts 22 terminated by disc portions 24 are molded into the plastic forming elements 12, 14, and 16. Body elements 18 and 20 are provided with semicircular recesses 26 into which the shafts 22 are disposed before body elements 18 and 20 are joined together, as with glue, screws, or a welding operation. Thus assembled, elements 12, 14 and 16 are allowed to rotate about their shafts 22 while being retained in position by disc portions 24.

The various plastic elements illustrated in FIG. 1 can be made by conventional injection molding techniques. Metal blocks which fit together into a single unit are machined to provide a mold having internal cavities whose configurations match those of the plastic elements to be produced. Molten plastic such as Nylon or styrene is injected into the cavities via small conduits in the mold. After the plastic hardens the metal blocks are separated and the plastic elements are removed, either manually or automatically by means of ejector pins which are movably mounted on the mold. Thereafter the mold is closed and the cycle is repeated to produce additional elements. Depending upon the size of the mold and the size and geometry of the plastic elements to be produced, the mold may have more than one internal cavity in order to produce more than one plastic element at a time. In such a situation, small conduits would be provided in the mold to convey molten plastic injected into the mold to each of the cavities, or conduits could lead from one cavity to another for this purpose. After the plastic hardens the molded elements remain connected by a plastic framework corresponding to the conduits, but the elements can easily be broken off of the framework to yield individual pieces. The small blemishes which result when elements are removed from the framework are usually insignificant.

The articulation of doll 10 is very limited. The arms and legs can sweep out arcs and the head can rotate, but movements that are more complex than this are not possible. The arms cannot be raised to the sides, the elbows do not flex, the wrist cannot be rotated, etc. Such limitations impart a corresponding limitation on the enjoyment that a child can derive from playing with the toy. Moreover, there is the danger that a child may become sufficiently frustrated that he breaks the doll by attempting to force a movement which the mechanism is incapable of permitting. Even with this limited articulation, however, doll 10 requires that seven elements be assembled during fabrication of the device. These assembly steps are a significant factor in the overall manufacturing cost. Techniques are known in the art for achieving a greater degree of articulation, as by providing ball-and-socket joints or hinging elements together, but such techniques increase the number of elements that must be assembled and further complicate the assembly process. Accordingly, in the prior art highly articulated figures are associated with correspondingly high manufacturing costs. Moreover, highly articulated figures tend to be delicate because of the number of individual pieces which must be assembled together.

SUMMARY OF THE INVENTION

Accordingly, one object of the present invention is to provide a highly articulated toy figure with minimalized assembly requirements.

Another object of the invention is to provide a figure which is highly articulated but which is nevertheless sturdy.

Another object of the invention is to provide an articulated figure having elements that can be molded simultaneously but that do not have to be broken away from a plastic frame prior to assembly.

Another object of the present invention is to provide an articulated figure, and a method for making it, whereby a plurality of first elements are movably joined to a corresponding plurality of second elements, the first elements being fabricated during one manufacturing step and the second elements being both fabricated and attached to the first elements in a second manufacturing step.

These and other objects of the invention can be attained by first molding a frame or skeleton of elements that can easily be broken apart. The elements of the frame provide portions of the joints ("half joints") which will be present in the completed figure. The figure is completed by leaving the frame in the mold while changing the mold inserts so that the second portions of the joints can be molded around the frame in order to complete the figure. After removal from the mold the figure remains relatively rigid until it is painted, if desired, and thereafter the figure is flexed to break the matrix. The net result is that a sturdy and fully articulated figure can be manufactured without incurring excessive assembly expenses.

BRIEF DESCRIPTION OF THE DRAWINGS

FIG. 1 is an exploded perspective view of a prior art figure having a low degree of articulation and relative high assembly costs;

FIG. 3 is a perspective view of completion elements that are molded around the frame of FIG. 2 during a second molding step in order to yield an articulated figure;

FIG. 6 is a perspective view of a single frame element which provides half of a hinged joint and half of a rotatable joint, the hinged joint having detents for retaining the figure at a set position.

DESCRIPTION OF THE PREFERRED EMBODIMENTS

Figure 2:
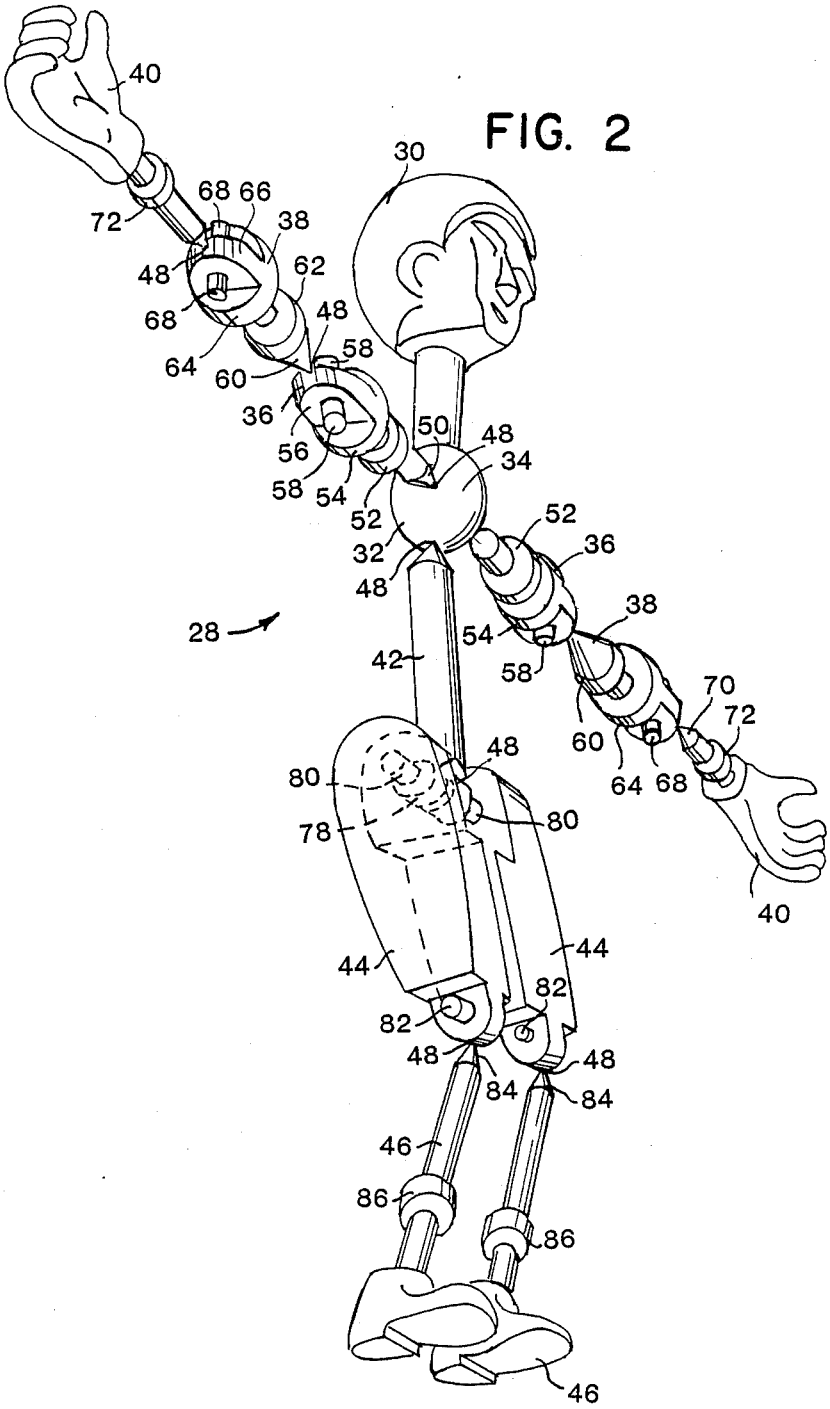
FIG. 2 is a perspective view of a frame which is formed in a single molding step and which provides portions of the joints present in an articulated figure according to the present invention.

Frame 28 in FIG. 2 includes head element 30 having ball portion 32. A slight blemish (accentuated for purposes of illustration) remains at injection gate 34, the site at which molten plastic for forming frame 28 was injected into the mold. Molten plastic so injected then flows through small conduits from one mold cavity to another to form upper arm frame elements 36, forearm frame elements 38, hand frame elements 40, body filler frame element 42, thigh frame elements 44, and foot frame elements 46, the conduits between mold cavities resulting in breakable portions 48 joining elements 30–46 of frame 28 after the plastic has hardened. It will be noted from FIG. 2 that frame 28 is symmetrical with respect to its vertical axis.

With continuing reference to FIG. 2, each upper arm frame element 36 includes a conical portion 50, the apex of which provides a breakable portion 48 joining the element 36 to portion 32. Each element 36 also includes a collar portion 52. In the completed figure portions 52 will act as half of 360° rotation joints positioned at the shoulders of the figure. Each element 36 also includes a flange 54 from which extension 56 projects. Pegs 58 protrude from extensions 56, and in the completed figure will provide half of 180° rotation hinge joints positioned at the shoulders of the figure.

With continuing reference to FIG. 2, the construction of forearm frame elements 38 is basically similar to that of upper arm frame elements 36. Elements 38 include conical portions 60, the apexes of which provide breakable portions 48 which join element 38 to elements 36. Elements 38 also include collar portions 62 which, in the completed figure, will provide half of 360° rotation joints positioned at the elbows of the figure. Elements 38 also include flanges 64 from which extensions 66 project, pegs 68 being provided on extensions 66. In the completed figure pegs 68 will provide half of 180° hinge joints positioned at the elbows of the figure. Hand elements 40 include conical portions 70, the apexes of which provide breakable portions 48 joining elements 40 to elements 38. Elements 40 also include collar portions 72 which, in the completed figure, will provide half of 360° rotation joints positioned at the wrists of the figure.

Figure 5A:
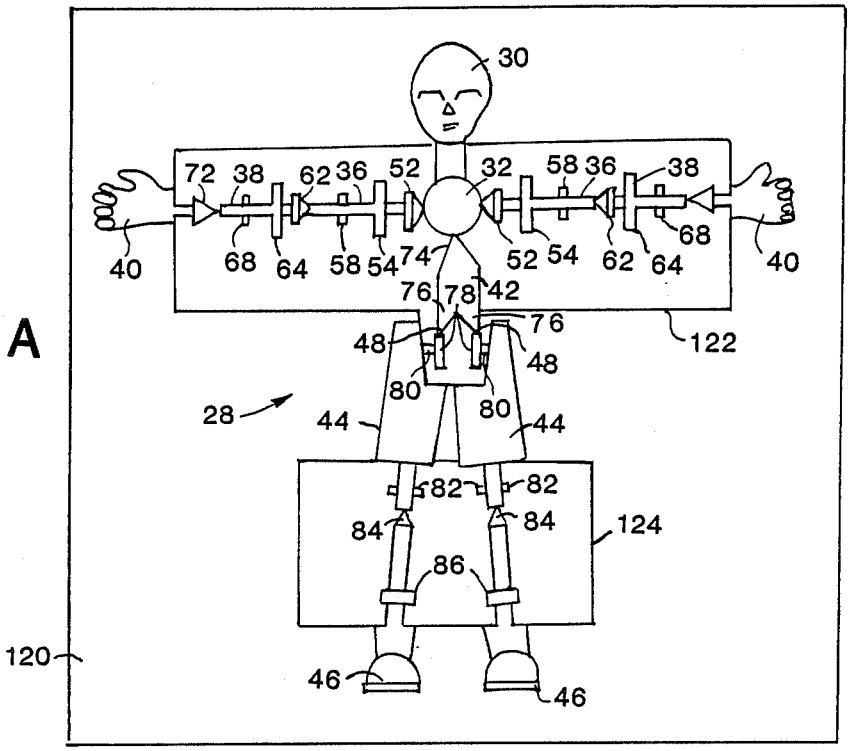
FIG. 5A is a stylized plan view of an open mold with the frame of FIG. 2 disposed therein, the head, hands, thighs, and feet being provided by cavities in the mold and the remaining elements illustrated in FIG. 2 being provided by a first pair of mold inserts.

With reference next to both FIGS. 2 and 5A, frame element 42 includes upper pointed region 74 whose apex provides a breakable portion 48 connecting element 42 to portion 32. Element 42 also includes a pair of lower pointed regions 76 having breakable portions 48 at their apexes to connect element 42 to the thigh frame elements 44. This connection occurs via collars 78 and shafts 80, which protrude from elements 44. In the completed figure, collars 78 will provide half of rotation joints that are positioned at the hips of the figure. In addition to collars 78 and shafts 80, elements 44 include pegs 82 near the lower ends thereof. In the completed figure, pegs 82 form half of 180° hinge joints positioned at the knees of the figure. Finally, foot elements 46 include conical portions 84, whose apexes provide the breakable portions 48 connecting elements 46 to elements 44. Elements 46 also include collars 86 which, in the completed figure, form half of 360° rotation joints positioned at the ankles of the figure.

FIG. 3 illustrates the completion elements 88 that are molded around frame 28 in order to complete the figure. The completion elements include thorax outer portion 90, which has internal cavities to accommodate ball portion 32 of head element 30, collar portions 52 of upper arm frame elements 36, and collars 78 of thigh frame elements 44. These cavities provide the remaining halves of the joints previously discussed for permitting movement of head element 30, upper arm elements 36, and thigh elements 44. Openings 92 at the lower end of portion 90 allow shafts 80 to extend to the cavities for accommodating collars 78. Neck opening 94, which leads to the cavity which envelope ball portion 32, is enlarged in order to permit a considerable degree of movement for head element 30. Openings 96 permit access to the cavities which envelope collar portions 52.

With continuing reference to FIG. 3, upper arm outer portions 98 have slots 100 to accommodate extensions 56 and openings 102 to accommodate pegs 58. Slots 100 and openings 102 complement pegs 58 to from the other halves of the 180° hinge joints positioned at the shoulders of the completed figure. Portions 98 also include openings 104 leading to internal cavities which accommodate collar portions 62 of forearm frame elements 60, thereby completing the 360° rotation joints at the elbows of the completed figure. Forearm outer portions 106 have slots 108 to accommodate extensions 66 of forearm frame elements 38 and openings 110 to accommodate pegs 68, thereby completing the 180° hinge joints positioned at the elbows of the completed figure. Portions 106 also have openings 112 leading to internal cavities which envelope collar portions 72 of hand frame elements 40, thereby completing the 360° rotation joints positioned at the wrists of the completed figure.

With continuing reference to FIG. 3, completion elements 88 also include leg outer portions 114. Portions 114 have slots 116 and openings 118, which accommodate pegs 82 of thigh frame elements 44 in order to complete the 180° hinge joints positioned at the knees of the completed figure. Openings 120 lead to internal cavities which accommodate collars 86 of foot frame elements 46, thereby completing the 360° rotation joints positioned at the ankles of the completed figure.

Figure 4:
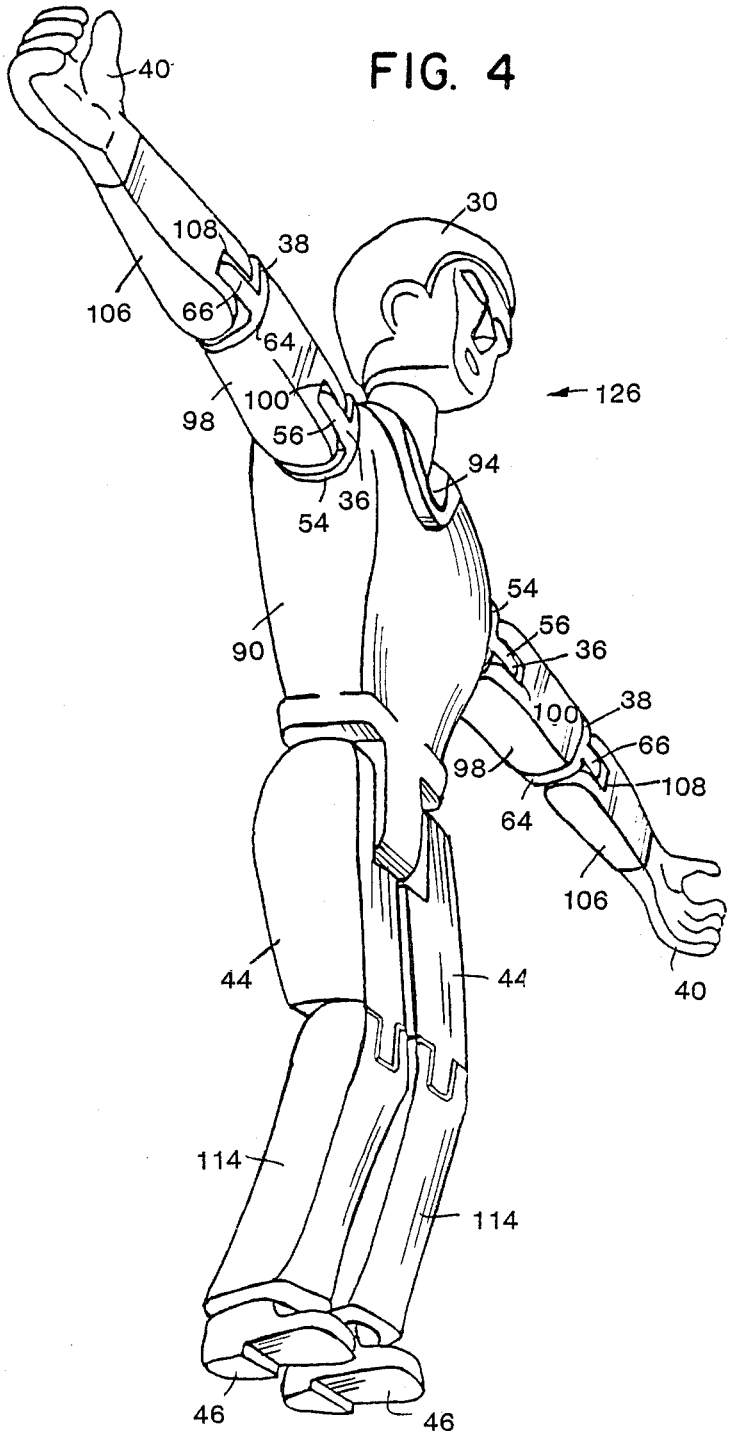
FIG. 4 is a perspective view of an articulated figure formed by the frame of FIG. 2 and the completion elements of FIG. 3.

FIG. 4 illustrates the completed figure formed by frame elements 28 of FIG. 2 and completion elements 88 of FIG. 4. It will be noted that head element 30, hand elements 40, thigh elements 44, and foot elements 46 of frame 28 provide significant portions of the outer surface of the figure. The completion elements 88 of FIG. 3 provide the remaining significant portions of the outer surface of the figure. However, portions of upper arm and forearm frame elements 36 and 38 are visable, and only frame element 42 is completely enveloped.

Figure 5B:
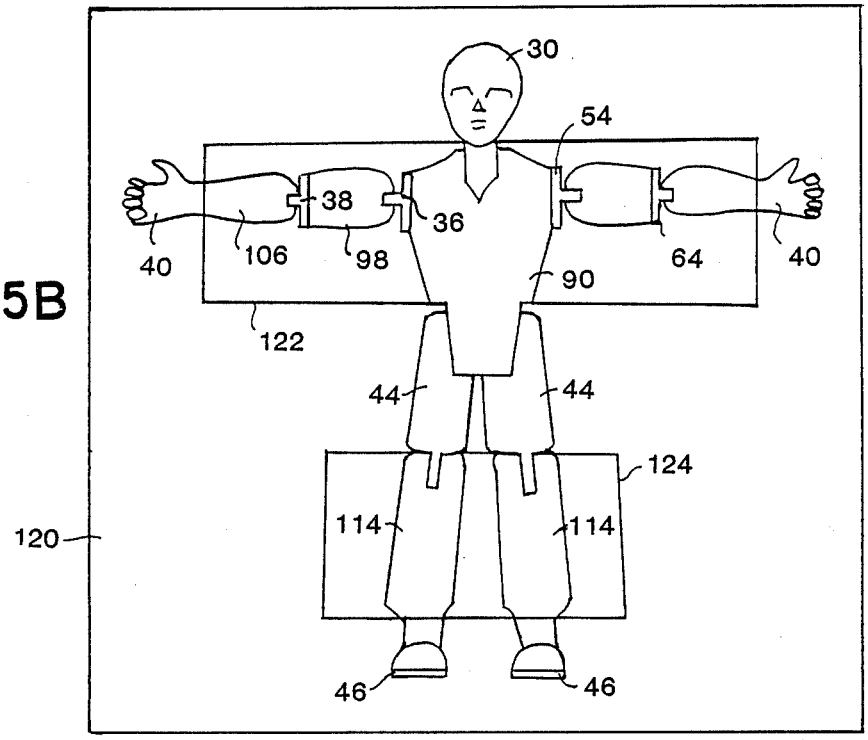
FIG. 5B is a stylized plan view corresponding to FIG. 5A after the first pair of mold inserts has been exchanged for a second pair and the completion elements have been molded around the frame.

Turning now to FIG. 5A, reference number 120 identifies a stylized representation of half of a main mold element having cavities machined therein for forming portions of head element 30, hand elements 40, thigh elements 44, and foot elements 46. Mold 120 is transferred by a pair of rectangular openings 122 and 124 to accommodate mold inserts, not illustrated. To begin fabrication of the figure, the first pair of inserts is positioned in openings 122 and 124, and then molten plastic is injected via gate 34. The first pair of inserts, together with those portions of elements 30, 40, 44, and 46 that are permanently machined into mold 120, form frame 28. After the plastic has hardened the first pair of mold inserts is removed but frame 28 is left in the mold. Thereafter, a second pair of mold inserts is positioned in mold 120 to form completion elements 88, as illustated in FIG. 5B. The completed figure is then removed from mold 120 and the production process can begin anew. The figure remains relatively rigid until it is flexed to break breakable portions 48, thereby facilitating a painting or other decorating operation, if desired.

A number of different plastics can be used in the first and second molding operations, and their colors may be different if desired in order to impart a pleasing appearance to the finished figure. The same type of plastic, for example Nylon or styrene, can be used for both molding operations. The plastic for the frame may be glass-filled to facilitate separation of the frame elements by making the breakable portions brittle. As is known in the art, molten plastic injected into a mold cavity cools fastest where it is in contact with the mold or other relatively cool surface, thereby temporarily forming a "skin" around plastic which is still in its molten state. Accordingly, in the second molding operation illustrated in FIG. 5B, the plastic injected for forming completion elements 88 forms a skin when it comes into contact with the relatively cooler portions of frame 28. This skin keeps the plastic of the first and second operations from fusing together when the second operation is conducted. If the temperature of the plastic for the second molding operation is unduly high, however, fusing might become a problem. Such a fusing problem could be rectified by using different plastics for the first and second molding operations (for example, Nylon for the first operation and styrene for the second), or by washing frame 28 with a lubricant (for example, a Teflon lubricant) before conducting the second operation.

The completed FIG. 126 illustrated in FIG. 4 is humanoid in form. The external decoration of such humanoid figures can be varied to provide dolls, toy soldiers, extraterrestrial aliens, etc., as market considerations indicate. However, the present invention is not limited to humanoid articulated toy figures. Animal articulated toy figures may also be commercially desirable at times, and such animal figures can be produced by suitable modification of frame 28 and completion elements 88. The production of humanoid and animal articulated toy figures, however, does not exhaust the present invention. It can also be used for producing other toys, such as a toy construction vehicle having rotatable wheels, rotatable cab, and jointed crane elements.

It may sometimes be desirable to provide articulated members which look at a predetermined position. FIG. 6 illustrates a frame element 38 having detents 128 on pegs 68. Upon completion of the second molding operation, detents 128 will provide a mild locking action to temporarily retain the articulated elements at their proper poitions. The locking force is determined by both the size and the geometrical configuration of the detents.

What we claim is:

1. An articulated toy figure, comprising:

(a) a first relatively rigid injection molded plastic element and at least one second relatively rigid injection molded plastic element, wherein the first element is connected to the at least one second element by a breakable portion and broken apart therefrom, wherein the at least one second element is positioned adjacent the first element, and wherein the at least one second element has integrally molded joint means; and (b) a third relatively rigid injection molded plastic element having a first portion thereof injection molded around part of the first element and a second portion thereof injection molded around part of the at least one second element to movably join the first element and the at least one second element together.

2. The figure as recited in claim 1, further comprising:

(c) at least one fourth relatively rigid injection molded plastic element connected to the at least one second element by a breakable position, broken apart therefrom and positioned adjacent thereto, the at least one fourth element having integrally molded joint means; and (d) at least one fifth relatively rigid injection molded plastic element having a first portion thereof injection molded around part of the at least one second element and a second portion thereof injection molded around part of the at least one fourth element to movably join the at least one second element and the at least one fourth element together.

3. The figure as recited in claim 2, further comprising:

(e) at least one sixth relatively rigid injection molded plastic element connected to the at least one fourth element by a breakable portion, broken apart therefrom and positioned adjacent thereto, the sixth element having integrally molded joint means; and (f) at least one seventh relatively rigid injection molded plastic element having a first portion thereof injection molded around part of the at least one fourth element and a second portion thereof injection molded around part of the at least one sixth element to movably join the at least one fourth element and the at least one sixth element together.

4. The figure as recited in claim 3, wherein the first element comprises:

(i) a ball portion, and (ii) a filler portion connected to the ball by a breakable portion, broken away therefrom and positioned adjacent thereto, the filler portion having integrally molded joint means.

5. The figure as recited in claim 4, further comprising:

(g) at least one eighth relatively rigid injection molded plastic element movably connected to the joint means of the filler portion, the at least one eighth element having integrally molded joint means.

6. The figure as recited in claim 5, further comprising:

(h) at least one ninth relatively rigid injection molded plastic element connected to the at least one eighth element by a breakable portion, broken apart therefrom and positioned adjacent thereto, the at least one ninth element having integrally molded joint means; and (i) at least one tenth relatively rigid injection molded element having a first portion thereof injection molded around part of the at least one eighth element and a second portion injection molded around the at least one ninth element to movably joint the at least one eigth element and the at least one ninth element together.

7. The figure as recited in claim 6, wherein the first element further comprises projections configured as a head and neck of the figure, wherein the third element is configured as a thorax, wherein one of the at least one second, fourth, fifth, sixth and seventh elements combine to be configured as a right shoulder, a right upper arm, a right elbow, a right lower arm, a right wrist and a right hand, wherein another of the at least one second, fourth, fifth, sixth and seventh elements combine to be configured as a left shoulder, a left upper arm, a left elbow, a left lower arm, a left wrist and a left hand, where in the joint means of the filler portion and one of the at least one eighth, ninth and tenth elements combine to be configured as a right hip, a right upper leg, a right knee, a right lower leg, a right ankle and a right foot, and wherein the joint means of the filler portion and another of the at least one eighth, ninth and tenth elements combine to be configured as a left hip, a left upper leg, a left knee, a left lower leg, a left ankle and a left foot.

8. The figure as recited in claim 7, wherein each joint means comprises means for preventing greater than 360° movement of the joint means relative to the element connected thereto.

9. An articulated toy figure, comprising:

(a) an injection molded plastic frame having a plurality of first elements connected by breakable portions and broken apart therefrom, each first element having first joint means integrally molded therewith; and (b) a plurality of second plastic elements injection molded around the frame, each second element having complementary second joint means for rotatably receiving each first joint means of each first element to provide a rotatable joint between each first and second element.

10. The figure as recited in claim 9, wherein each joint means includes a peg and a collar, and wherein the means for cooperating includes cavity means having an inner surface with dimensions substantially identical to the outer surface dimension of the peg and collar for enclosing each of the peg and collar.

11. The figure as recited in claim 10, wherein the joint means further comprises an integrally molded detente, and wherein the cavity means includes a matching detente of reverse configuration, which detentes combine to prevent greater than 360° rotation of the joint means relative to the means for cooperating.

12. The figure as recited in claim 9, wherein the plurality of first elements comprises:

(i) a head element having a ball portion integrally molded therewith;

(ii) a pair of upper arm elements disposed at radial positions with respect to the ball element;

(iii) a pair of forearm elements positioned adjacent the upper arm elements;

(iv) a pair of hand elements positioned adjacent the forearm elements;

(v) a body filler element disposed at a radial position with respect to the ball element;

(vi) a pair of thigh elements positioned adjacent the body filler element; and (vii) a pair of lower leg/foot elements positioned adjacent the thigh elements.

13. A method for injection molding an articulated toy figure using a mold, comprising the steps of:

(a) injection molding in the mold a frame having a plurality of first elements, each first element having a breakable portion; and (b) injection molding again, without removing the frame from the mold and while the frame remains unbroken, to form a plurality of second plastic elements around the frame which span said breakable portions.

14. The method as recited in claim 13, wherein the step (a) of conducting a first molding operation further includes the step of (i) placing at least one first insert in the mold, and wherein the step (b) of conducting a second molding operation further includes the steps of (i) leaving the frame in the mold, and (ii) replacing said at least one first insert with at least one second insert.

15. The method as recited in claim 14, wherein the step (a) of conducting a first molding operation further includes the step of (ii) molding each of the plurality of first elements with joint means, and wherein the step (b)(ii) of replacing said at least one first insert is conducted by using said at least one second insert which conveys molten plastic to the joint means.

16. The method as recited in claim 15, further comprising the steps of:

(c) decorating the figure; and (d) breaking the breakable portions.

17. The method as recited in claim 16, wherein the step (d) of breaking the breakable portions is conducted by flexing the figure.

18. The articulated toy figure made by the method of claim 13.

19. The articulated toy figure made by the method of claim 14.

20. The articulated toy figure made by the method of claim 15.

21. The articulated toy figure made by the method of claim 16.

22. The articulated toy figure made by the method of claim 17.

* * * * *

UNITED STATES PATENT AND TRADEMARK OFFICE

CERTIFICATE OF CORRECTION

PATENT NO. : 4,571,209

DATED : Feb. 18, 1986

INVENTOR(S) : MANNING et al.

It is certified that error appears in the above-identified patent and that said Letters Patent is hereby corrected as shown below:

Col. 5

Line 51, "look" s/b --lock--.

Col. 6

Line 63, "eigth" s/b --eighth--.

Signed and Sealed this

*Thirteenth* Day of *May 1986*

[SEAL]

*Attest:*

DONALD J. QUIGG

*Attesting Officer*

*Commissioner of Patents and Trademarks*